US007711130B2

(12) United States Patent
Husung

(10) Patent No.: US 7,711,130 B2
(45) Date of Patent: May 4, 2010

(54) HEARING AID WITH AN OPTICAL MICROPHONE

(75) Inventor: Kunibert Husung, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1077 days.

(21) Appl. No.: 11/388,018

(22) Filed: Mar. 23, 2006

(65) Prior Publication Data

US 2006/0233398 A1 Oct. 19, 2006

(30) Foreign Application Priority Data

Mar. 24, 2005 (DE) ..... 10 2005 013 833

(51) Int. Cl.
*H04R 25/00* (2006.01)
*H04R 21/02* (2006.01)

(52) U.S. Cl. ..... 381/172; 381/369

(58) Field of Classification Search ..... 381/172; 356/505

See application file for complete search history.

(56) References Cited

U.S. PATENT DOCUMENTS 7,116,430 B2 * 10/2006 Degertekin et al. ..... 356/505

OTHER PUBLICATIONS

Peter Schreiber, Sergey Kudaev, Ralf Rosenberger, Peter Dannberg, Bernd Höfer; "Optisches Mikrofon" (Optical Microphone); Fraunhofer IOF Annual Report 2003; pp. 84-87.

* cited by examiner

*Primary Examiner*—Brian Ensey

(57) ABSTRACT

A hearing aid is provided. The hearing aid includes at least one optical microphone. The at least one optical microphone comprises an acoustic-optical transformer for transforming an acoustic input signal into an optical signal, the optical signal is processed in the hearing aid using an optical signal processing unit, and the processed optical signal is transformed into an acoustic output signal using an opto-electrical transformer.

6 Claims, 1 Drawing Sheet

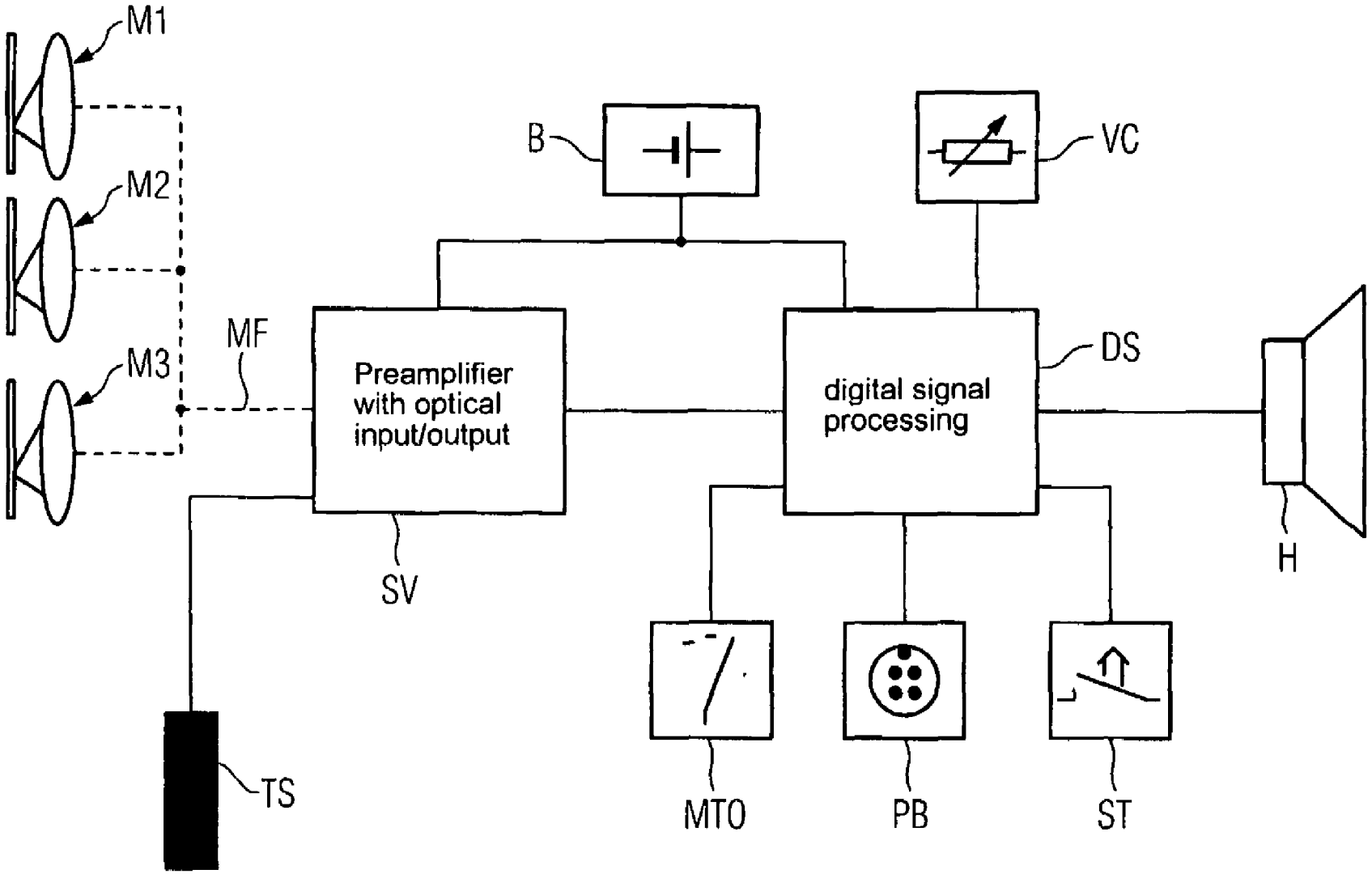
H
VC
DS
ST
digital signal processing
PB
MTO
B
Preamplifier with optical input/output
SV
MF
TS
M1
M2
M3

HEARING AID WITH AN OPTICAL MICROPHONE

CROSS REFERENCE TO RELATED APPLICATIONS

This application claims priority to the German Application No. 10 2005 013 833.0, filed Mar. 24, 2005 which is incorporated by reference herein in its entirety.

FIELD OF INVENTION

The present invention relates to a hearing aid apparatus with at least one microphone. Aside from the conventional behind-the-ear hearing devices and in-the-ear hearing devices, the present invention particularly also relates to implants.

BACKGROUND OF INVENTION

Hearing aid devices feature one or a number of microphones. Electret microphones are typically used in the hearing aid devices. These and/or their downstream signal processing, if applicable, nevertheless indicate problems regarding the electromagnetic compatibility (EMC). This is due, on the one hand, to the microphone conductors operating as antennae and the impedance converters in the microphone operating as demodulators. The electromagnetic waves, which are injected across the microphone conductors, can also be already demodulated in the preamplifier.

SUMMARY OF INVENTION

Furthermore, conventional microphones exhibit a high sensitivity towards humidity. An excessively high air humidity frequently results in the device failing.

In many cases, modern hearing devices are equipped with two or three microphones so as to achieve a directional effect. The electrical terminals of three microphones are then to be implemented for instance with nine terminal stranded wires. This gives rise to a very complex mechanical design, which is also relatively interference prone.

No means has hitherto been directed at the complex design. The electromagnetic compatibility of the microphone and of the microphone input amplifier could only be improved by installing high-frequency filters.

The article "Optisches Mikrofon" ["Optical microphone"] by Peter Schreiber et al., Fraunhofer IOF Annual Report 2003, pages 84 to 87 discloses a microphone with optical sampling. In this case, sound waves are detected on a microphone membrane. This sensor principle also allows confocal microphones to be realized.

An object of the present invention is thus to simplify the design of a hearing aid apparatus and at the same time increase its electromagnetic compatibility.

This object is achieved according to the invention by means of a hearing aid apparatus with at least one microphone, which is configured as an optical microphone. The input-side signal processing is thus partially carried out using optical means, with the acoustic signal initially being first converted into an optical signal via an acousto-optical converter, before being converted into an electrical signal by means of an opto-electrical converter.

The use of an optical microphone is advantageous in that it does not feature any metal parts, thereby obviating the risk of corrosion. Furthermore, the optical signal processing allows the EMC problems to be avoided.

It has further proven advantageous for microphone arrays to be manufactured from optical microphones, since a large number of stranded wires can be dispensed with. Furthermore, cerumen protection can be easily realized since optical microphones exhibit a humidity-insensitive design. Last but not least, optical microphones offer significant advantages in the sphere of action of the magnetic fields, as they are insensitive thereto.

The hearing aid apparatus according to the invention preferably has a number of optical microphones, which are connected to a common optical fiber. This brings about significant advantages, relating in particular to a three-wire cabling of an electret microphone.

The at least one optical microphone can be connected to an amplifier with an optical input via a multimode fiber. A plurality of modes can thus be forwarded from the optical microphone to the evaluation device.

Furthermore, the hearing aid apparatus can comprise a laser diode for supplying the optical microphone. An energetic favorable light source can thus be used for the optical microphone.

A laser diode with a different wave length in each instance can further be used for each of the number of optical microphones. A common evaluation unit with corresponding filters can thus be used.

According to a further embodiment, a polarization device can be provided in the hearing aid apparatus, so that the light of a first of the number of optical microphones can be polarized differently from the light of a second of the number of optical microphones. A common processing unit can also be used with this embodiment, if a corresponding electronically controlled polarization filter is used for filtering out the desired polarization.

With a further embodiment, provision is made for the membranes of the number of microphones to each comprise different reflectance levels. The individual microphones can thus be easily evaluated as a function of their amplitude.

BRIEF DESCRIPTION OF THE DRAWING

The present invention is now described in more detail with reference to the appended drawing, which illustrates a detailed schematic diagram of a hearing aid device according to the invention with optical microphones.

The exemplary embodiment illustrated below in more detail represents a preferred embodiment of the present invention.

DETAILED DESCRIPTION OF INVENTION

The hearing aid device selected in the exemplary embodiment features three optical microphones M1, M2 and M3. A membrane is scanned in each optical microphone using suitable optics, said membrane being moved through the incoming sound. The microphones M1, M2 and M3 form a so-called microphone array, with the functionality of a directional microphone being able to be ensured for instance. Hearing aid devices with two, four, five etc. optical microphones can naturally also be realized.

The individual microphones M1, M2 and M3 are supplied with the light of a laser diode via a common multimode fiber MF, which is correspondingly branched, said laser diode being arranged in the control and preprocessing unit SV. Aside from the optical output, this control and preprocessing unit SV also contains a preamplifier with an optical input, so that the optical signals incoming from the individual microphones M1, M2 and M3 via the multimode fiber MF can be preamplified.

Alternatively, each individual microphone M1, M2 and M3 can exhibit its own optical connection with an individual glass fiber cable in each instance to the control and preprocessing unit SV (not shown in the FIGURE). However, simple, cost-effective glass fiber cables can thereby also be used without branching, however the signal processing outlay in the control and preprocessing unit SV thus increase.

With the exemplary hearing aid device displayed, a telephone coil TS is further provided as an input unit for the control and preprocessing unit SV. The output signal of the control and preprocessing unit SV is supplied to a digital signal processing DS with a clocked end stage. The digital signal processing DS can be controlled by a program switch MTO, a programming connector PB, a situation key ST and a VC actuator VC. A battery B powers the control and preprocessing unit SV and the digital signal processing DS. The output signal of the digital signal processing DS is supplied to an earpiece H.

If acoustic noise now falls onto the membranes of the microphones M1, M2 and M3, the light sent to these microphones M1, M2 and M3 is modulated correspondingly with the reflection. The modulated signals are sent back over the branched multimode fiber MF to the control and preprocessing unit SV and are processed there individually. In this case, the individual optical signals are distinguished on the basis of light intensity, color or polarization. The optical signals are thereupon converted into electrical analogue signals and are subsequently transformed into digital signals. The further signal processing is carried out as with conventional hearing aid devices.

In summary, it is possible to determine that the robust, non-failure-prone optical microphones are especially suited to the implementation of microphone arrays in hearing aid devices.

The invention claimed is:

1. A hearing aid, comprising;

a plurality of optical microphones connected to a common optical fiber, at least one optical microphone comprises an acoustic-optical transformer for transforming an acoustic input signal into an optical signal, the optical signal is processed in the hearing aid using an optical signal processing unit, and the processed optical signal is transformed into an acoustic output signal using an opto-electrical transformer.

2. A hearing aid, comprising:

at least one optical microphone; and an amplifier with an optical input, the optical microphone connected to the amplifier by a multimode fiber, wherein the optical microphone comprises an acoustic-optical transformer for transforming an acoustic input signal into an optical signal, the optical signal is processed in the hearing aid using an optical signal processing unit, and the processed optical signal is transformed into an acoustic output signal using an opto-electrical transformer.

3. The hearing aid according to claim 2, further comprising a laser diode for supplying light to the optical microphone.

4. The hearing aid according to claim 1, further comprising a plurality of laser diodes for supplying light to the optical microphones, wherein each laser diode is assigned to one of the optical microphones, the light emitted by each laser diode having a different wavelength.

5. The hearing aid according to claim 1, further comprising a polarization device for polarizing light processed by the optical microphones such that the light processed by a first of the optical microphones has a polarization different from the light processed by a second of the optical microphones.

6. The hearing aid according to claim 1, wherein each optical microphone comprises a membrane having a different reflectivity.

* * * * *